US009831566B2

(12) United States Patent
Delestre et al.

(10) Patent No.: US 9,831,566 B2
(45) Date of Patent: Nov. 28, 2017

(54) RADIATING ELEMENT FOR AN ACTIVE ARRAY ANTENNA CONSISTING OF ELEMENTARY TILES

(75) Inventors: Xavier Delestre, Paris (FR); Michele Labeyrie, Fontenay aux Roses (FR); Christian Renard, Boulogne Billancourt (FR)

(73) Assignee: THALES, Courbevoie (FR)

( * ) Notice: Subject to any disclaimer, the term of this patent is extended or adjusted under 35 U.S.C. 154(b) by 656 days.

(21) Appl. No.: 14/118,194

(22) PCT Filed: May 15, 2012

(86) PCT No.: PCT/EP2012/059071

§ 371 (c)(1),
(2), (4) Date: Nov. 15, 2013

(87) PCT Pub. No.: WO2012/156424

PCT Pub. Date: Nov. 22, 2012

(65) Prior Publication Data

US 2014/0104135 A1 Apr. 17, 2014

(30) Foreign Application Priority Data

May 17, 2011 (FR) ..... 11 01499

(51) Int. Cl.
*H01Q 21/06* (2006.01)
*H01Q 21/00* (2006.01)
*H01Q 9/04* (2006.01)

(52) U.S. Cl.
CPC ..... *H01Q 21/065* (2013.01); *H01Q 9/0407* (2013.01); *H01Q 21/0087* (2013.01)

(58) Field of Classification Search
CPC .... H01Q 21/065; H01Q 21/00; H01Q 9/0407; H01Q 21/0087
USPC ..... 343/893
See application file for complete search history.

(56) References Cited

U.S. PATENT DOCUMENTS 5,210,542 A * 5/1993 Pett ..... H01Q 1/3275 343/700 MS
5,434,581 A * 7/1995 Raguenet ..... H01Q 13/18 343/700 MS
5,977,914 A * 11/1999 Harano ..... H01Q 3/16 343/700 MS (Continued)

FOREIGN PATENT DOCUMENTS

EP 1930982 A1 6/2008

*Primary Examiner* — Dameon E Levi
*Assistant Examiner* — Jennifer F Hu
(74) *Attorney, Agent, or Firm* — Baker & Hostetler LLP

(57) ABSTRACT

An antenna comprises a plurality of tiles forming an antenna plane, each of said tiles comprising a plurality of radiating elements. Each radiating element comprises a metallic upper patch disposed above a metallic lower patch, the two patches being separated by a layer insulating them electrically. The lower patch is fed with electric current. Each radiating element comprises a conducting frame disposed parallel to the antenna plane and framing the two patches of said element, the two so-called patches being coupled electromagnetically through the aperture of said frame whose body comprises a rear face of small cross section disposed on the side of the lower patch and a front face of larger cross section disposed on the side of the upper patch, so as to widen the angular scan field of a beam in a plane orthogonal to the antenna plane.

9 Claims, 6 Drawing Sheets

(56) References Cited

U.S. PATENT DOCUMENTS

| | | | | |
|---|---|---|---|---|
| 6,023,244 | A * | 2/2000 | Snygg | H01Q 1/246 343/700 MS |
| 6,211,824 | B1 * | 4/2001 | Holden | H01Q 1/523 343/700 MS |
| 2002/0109633 | A1 * | 8/2002 | Ow | H01Q 9/0407 343/700 MS |
| 2003/0043074 | A1 * | 3/2003 | Bhattacharyya | H01Q 9/0435 343/700 MS |
| 2003/0067410 | A1 * | 4/2003 | Puzella | H01Q 9/0407 343/700 MS |
| 2004/0023058 | A1 | 2/2004 | Kovacs et al. | |
| 2009/0096679 | A1 * | 4/2009 | Harokopus | H01Q 1/523 343/700 MS |
| 2010/0126010 | A1 | 5/2010 | Puzella et al. | |
| 2010/0141517 | A1 * | 6/2010 | Surittikul | H01Q 3/446 342/357.64 |
| 2015/0207213 | A1 * | 7/2015 | Forslund | H01Q 1/3291 343/713 |

* cited by examiner

RADIATING ELEMENT FOR AN ACTIVE ARRAY ANTENNA CONSISTING OF ELEMENTARY TILES

CROSS-REFERENCE TO RELATED APPLICATIONS

This application is a National Stage of International patent application PCT/EP2012/059071, filed on May 15, 2012, which claims priority to foreign French patent application No. FR 1101499, filed on May 17, 2011, the disclosures of which are incorporated by reference in their entirety.

FIELD OF THE INVENTION

The present invention relates to a single- or dual-polarization radiating element for active array antenna consisting of juxtaposed tiles. It applies notably in the field of active array antennas consisting of elementary tiles.

BACKGROUND

In the present patent application, an active array antenna architecture is said to be of 'tile' type if its active components, notably its amplifiers and its phase shifters, are disposed in planes parallel to the radiating plane, so as to obtain a mechanically orientable antenna of restricted depth or one that can be installed on the surface of a carrier.

The radiating elements of such an array antenna can be grouped into sub-arrays of $2^n$ radiating elements (where n is a positive integer), called 'elementary tiles'. Indeed, the pitch of the array, that is to say the distance between the center of 2 neighboring radiating elements, generally around $\lambda/2$ for an electronic-scanning antenna (where $\lambda$ designates the wavelength of the radiated wavebeam), is much too small to embed the components required for individual control of the radiating elements. The radiating elements of an elementary tile are disposed row-wise (or column-wise) perpendicularly to the antenna scan plane and are connected to a distributor consisting of Wilkinson dividers of restricted proportions whose input is linked to an active pathway of the antenna. The surface area of 2, 4 or 8 radiating elements is thus available for embedding the active and passive components required to constitute an active pathway. The pitch of the array must however be widened, up to about $0.65\lambda$, so as to obtain a sufficient area to allow the active pathways to be housed in a metal casing and the mechanical play which is indispensable for an array-like assemblage, while being compatible with the intended beam scan field.

Unfortunately, such an array pitch limits the antenna's pointing performance, notably when it is desired to scan the beam in a plane along the orientation of the radiated electric field, this plane being called E subsequently.

A major drawback of the array-like arrangement of radiating elements of relatively significant dimensions, is that blind directions appear, that is to say directions in which it is not possible to scan the beam. A blind direction is related to the fact that, for a given frequency and a particular pointing, the active SWR (Standing Wave Ratio) at the input of each of the radiating elements attains a very high value, the reflection coefficient being close to 1. This phenomenon, which is destructive for the active circuits of the antenna, corresponds to the bringing into phase of the couplings between a large number of radiating elements and an arbitrary radiating element situated in the middle of the array of elements.

SUMMARY OF THE INVENTION

The aim of the invention is notably to suppress the blind directions that are customarily observed in active array antennas. Accordingly, the invention proposes notably to improve the radioelectric behavior of the radiating elements forming the tiles, so as to obtain radiating elements exhibiting very good performance once grouped together on a tile, whether this be in terms of operating bandwidth or active reflection coefficient. For this purpose, the subject of the invention is an antenna comprising a plurality of tiles forming an antenna plane, each of said tiles comprising a plurality of radiating elements. Each radiating element comprises a metallic upper patch disposed above a metallic lower patch, the two patches being separated by a layer insulating them electrically. The lower patch is fed with electric current. Each radiating element comprises a conducting frame disposed parallel to the antenna plane and framing the two patches of said element, the two so-called patches being coupled electromagnetically through the aperture of said frame whose body comprises a rear face of small cross section disposed on the side of the lower patch and a front face of larger cross section disposed on the side of the upper patch, so as to widen the angular scan field of a beam in a plane orthogonal to the antenna plane.

Advantageously, each radiating element can comprise parasitic elements forming strips parallel to the edges of the upper patch.

Advantageously, the lower patch of each radiating element being able to be fed with electric current by a core of a coaxial line whose shielding can be linked to a ground plane disposed under said lower patch on the opposite side to the upper patch, said core can comprise a capacitive disk disposed between said lower patch and said ground plane.

In one embodiment, said lower patch can comprise a set of two demetallized slots, said core being able to be connected to said lower patch at a position centered on an axis of symmetry of said lower patch and as close as possible to one of its edges.

In another embodiment, said lower patch can comprise a set of four demetallized slots, said core being able to be connected to said lower patch at a position centered on an axis of symmetry of said lower patch and a core of a second coaxial line being able to be connected to said lower patch at a position centered on the other axis of symmetry of said lower patch.

Advantageously, the tiles are separated by a conducting seal. The antenna can then advantageously comprise a layout of metallized holes produced inside the tiles along the conducting seal.

Advantageously, the frame can be made of a dielectric material which is metallized over the whole of the external surface of the body of the frame, with the exception of a slot disposed on the front face of the frame. For example, the slot can be ring-shaped.

A main advantage of the invention described above is further that, compared with the systems customarily used, such as for example the dielectric layers of WAIM (Wide Angle Impedance Match) type aimed at reducing the angle of incidence of the wave on the array, it has practically no effect on the active SWR on the axis of the radiating elements in the middle of the array and does not increase the thickness of the antenna.

BRIEF DESCRIPTION OF THE DRAWINGS

Other characteristics and advantages of the invention will become apparent with the aid of the description which follows offered in relation to appended drawings which represent.

DETAILED DESCRIPTION

On the front face, a tile comprises one or more rows of radiating elements. At the rear, it comprises one or more distributors of triplate circuit or "microstrip" type, followed by other printed circuit layers on which the controls and the active and passive components are disposed. The circuits are assembled together by various techniques, whether involving pressing, glue bonding or else brazing.

Figure 1:
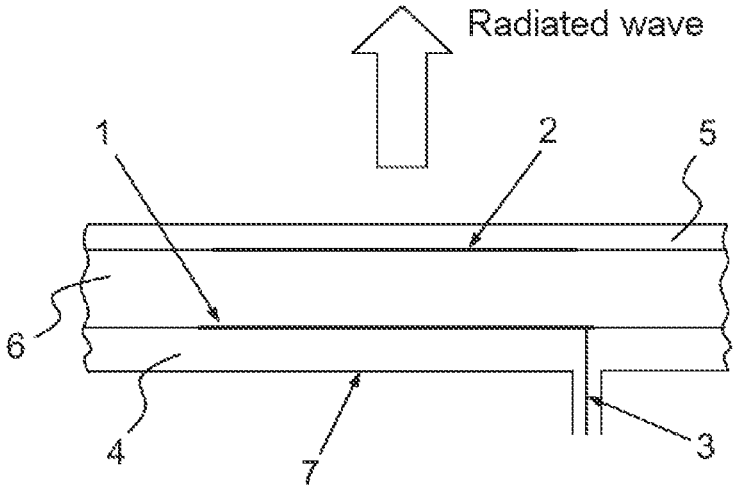
FIG. 1, an exemplary radiating element according to the prior art.

FIG. 1 illustrates an exemplary radiating element according to the prior art. It comprises notably two superposed metallic patches 1 and 2 of square and flat shape, the lower patch 1 being excited by a core 3 of a coaxial line connected to the middle of one of its edges for the polarization considered. The lower patch and the upper patch 1 and 2 are etched on printed circuits 4 and 5 respectively, said printed circuits being separated from one another by a layer of air or foam 6 with low dielectric constant, the upper patch 2 being disposed on the side of the printed circuit 4 facing the lower patch 1. The printed circuit 4 comprises, on its opposite face from the lower patch 1, a ground plane 7 connected to the shielding of the coaxial line. As illustrated by FIG. 1, once the coaxial line has been fed with current, a wave is radiated upwards.

Figure 2:
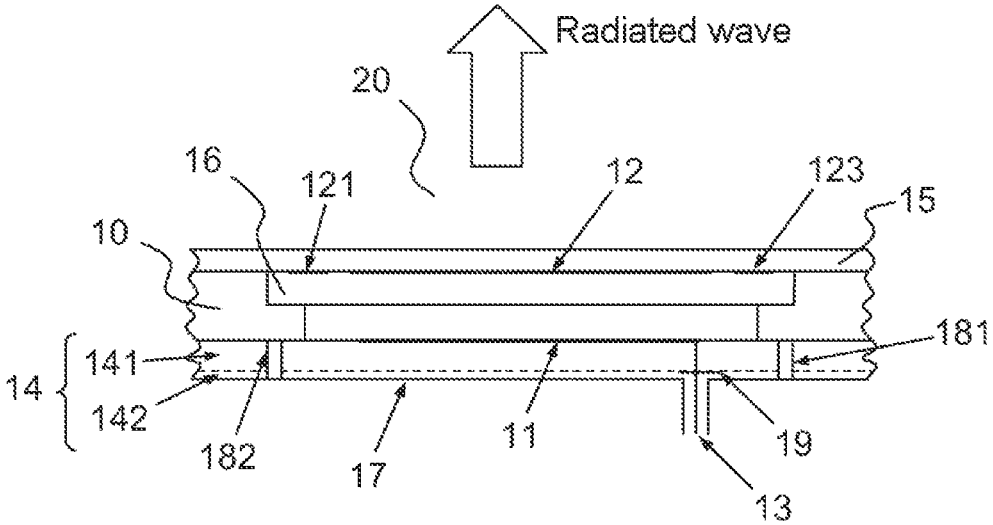
FIG. 2, an exemplary radiating element according to the invention.

FIG. 2 illustrates an exemplary radiating element 20 according to the invention. In a manner analogous to the example of FIG. 1, it comprises a lower metallic patch 11 printed on a circuit 141 and fed by a core 13 of a coaxial line, an upper metallic patch 12 printed on a circuit 15, the two patches being separated by an insulating layer 16, air for example. But according to the invention, it also comprises a frame 10, at least one metallized hole such as holes 181 and 182 and a capacitive disk 19 etched on one face of a printed circuit 142, the other face of which forms a ground plane 17. Moreover, the upper metallic patch 11 comprises parasitic elements 121, 122, 123 and 124, of which only the elements 121 and 123 are represented in FIG. 2.

By virtue of an optimized radiating element such as this, it is possible to obtain, with a beam pointed in the axis, an active reflection coefficient in the axis of less than −18 dB in a band of frequencies of 15%. As described hereinafter in the present patent application, this makes it possible to suppress the blind directions that are observed in tiled active array antennas when the beam is off-boresighted in the E plane, that is to say along the orientation of the radiated electric field, genuine holes being able to be observed in the radiation pattern of the element situated in the middle of the array of such antennas.

Figure 3:
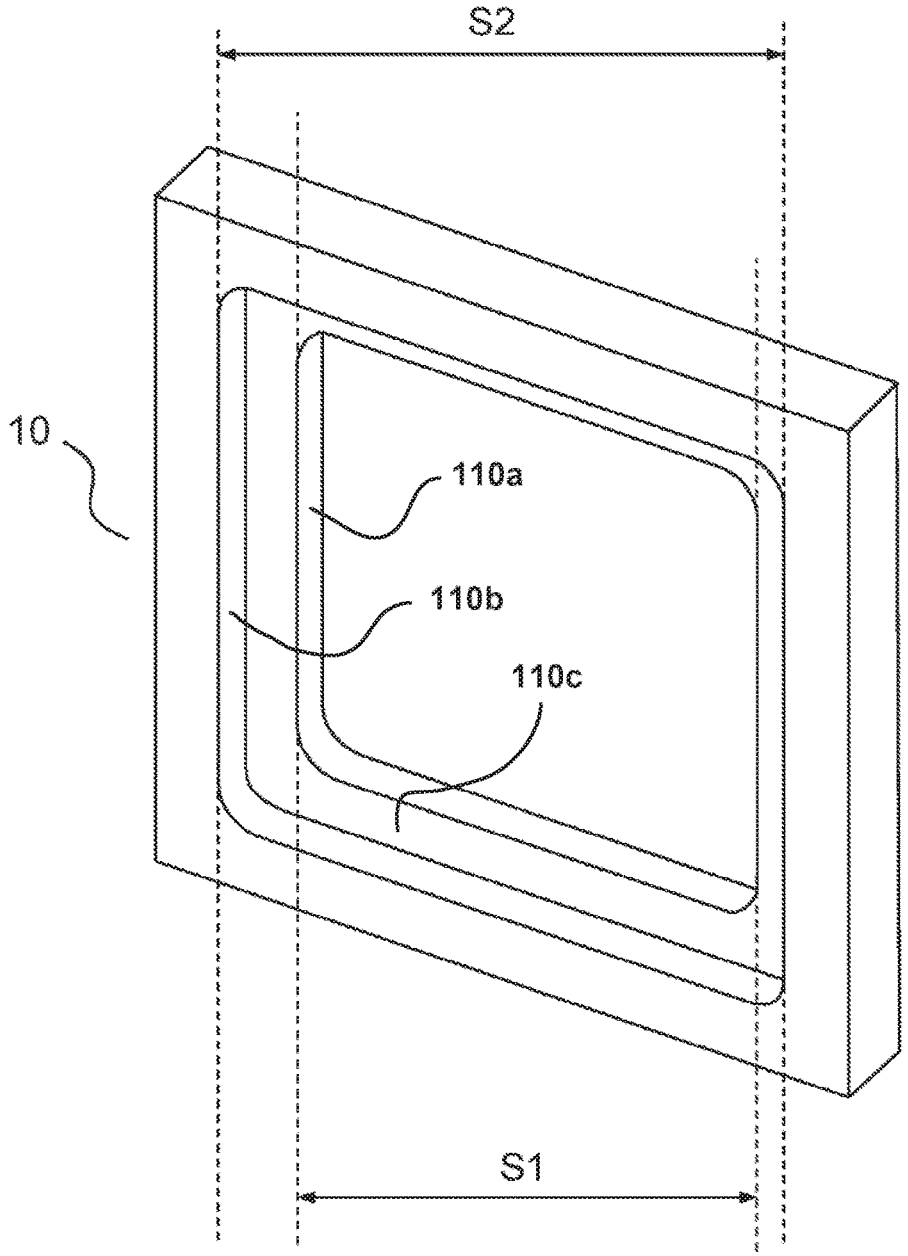
FIG. 3, an exemplary frame according to the invention.

FIG. 3 illustrates the exemplary frame 10 according to the invention. The two superposed patches 11 and 12 are coupled electromagnetically to one another by proximity, through the frame 10 made of dielectric material which is metallized on its external surface. The frame 10 forms a substantially square aperture, this aperture comprising at the minimum two different cross sections S1 and S2 in the thickness of the frame. A small cross section S1 is defined by a surface of a first wall 110*a* and a large cross section S2 is defined by a surface of a second wall 110*b*. The first wall 110*a* is spatially separated from the second wall 110*b* by a stepped surface 110*c*. In addition, each of the first wall 110*a* and the second wall 110*b* defines a 90° angle relative to a plane of the stepped surface 110*c*. Accordingly, a surface of the first wall 110*a* is parallel to a surface of the second wall 110*b*. The small cross section S1 is disposed on the side of the lower patch 11. It constitutes a portion of waveguide greatly under cutoff, the cutoff frequency of the waveguide of cross section S1 being equal to 1.25 times the central operating frequency of the radiating element 20. The propagation of the wave from the lower patch 11 to the upper patch 12 therefore takes place through evanescent modes. An operating principle of the radiating element 20 comprising the superposed patches 11 and 12 is to contrive matters so that the admittance of the upper patch 12 referred to the level of the lower patch 11 is the conjugate of that of the latter. This inversion of admittance is facilitated by the presence of the portion of waveguide of cross section S1, which makes it possible to obtain a coupling between the two patches 11 and 12, allowing impedance matching at the input of the radiating element 20. The large cross section S2 is disposed on the side of the upper patch 12. It makes it possible to minimize the metallic surface exhibited around the arrayed radiating elements when the latter operate in reception, thereby reducing reflections. Reciprocally, on transmission, this characteristic makes it possible to reduce the active SWR of a radiating element in the middle of the array.

Figure 4A:
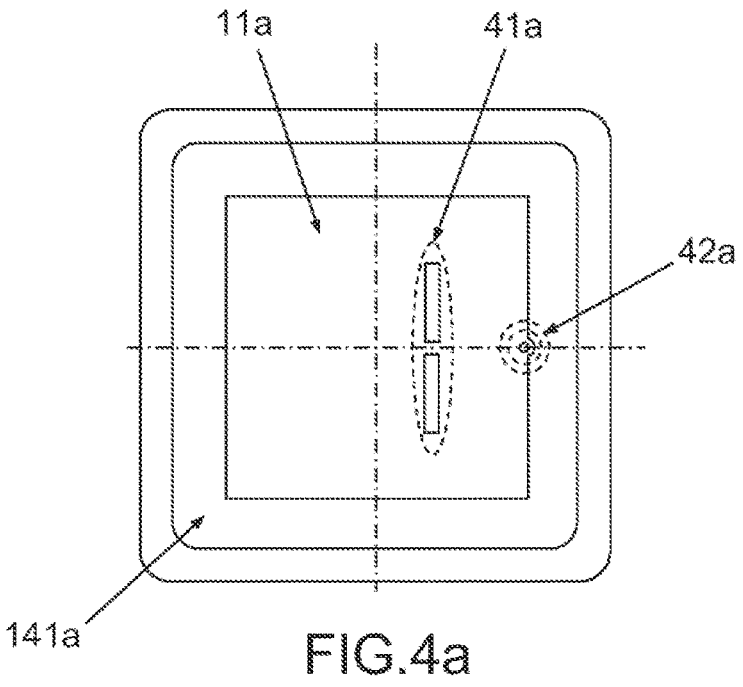
FIGS. 4*a* and 4*b*, two exemplary embodiments of a lower patch according to the invention.
Figure 4B:
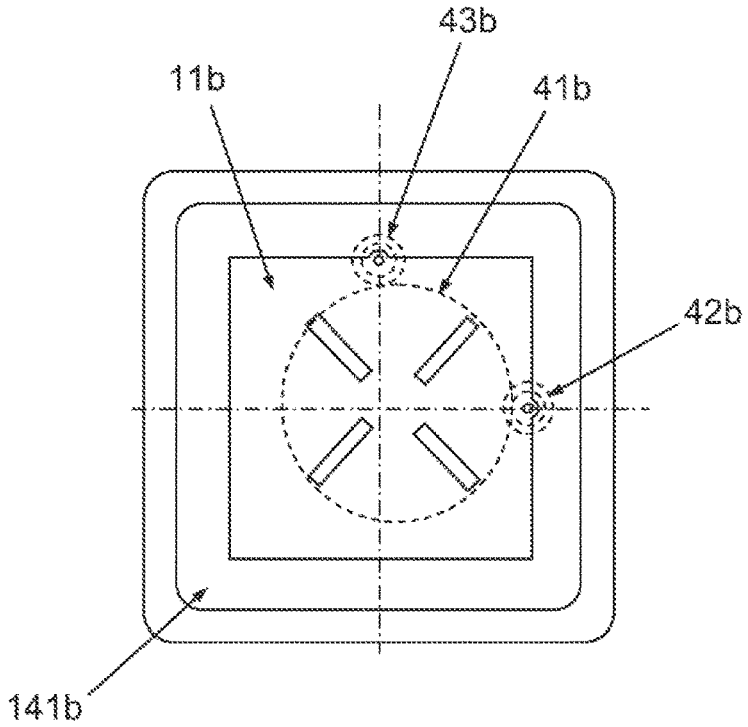

FIGS. 4*a* and 4*b* illustrate two variant embodiments of the lower patch 11 according to the invention, an exemplary single-polarization patch 11*a* and an exemplary dual-polarization patch 11*b* respectively. The lower patches 11*a* and 11*b* can be etched on the front face of a dielectric substrate 14 consisting of two layers formed by the assembled circuits 141 and 142. The layer formed by the circuit 142, the thickness of which is reduced to the minimum, is disposed on the side of the coaxial feed line of the radiating element 20. This structure makes it possible to etch on one of the two layers, for example that formed by the circuit 142, and in their joining plane, a metallic disk 19 linked electrically to the core 13 of the coaxial feed line. This disk 19 facing the ground plane 17 of the radiating element 20 constitutes a capacitance making it possible to compensate the series inductance caused by the length of the core 13 situated between the patch 11 and the ground plane 17. This capacitive correction makes it possible to center on the Smith chart the impedance locus corresponding to the active SWR on the axis of the radiating element 20 in the middle of the array and thus to optimize it. To obtain a radiating element 20 with a single polarization, the patch 11*a* can comprise a set 41*a* of two demetallized slots disposed at the positions illustrated by FIG. 4*a*. The core 13 can then be centered on the axis of the patch 11*a* and connected as close as possible to one of the radiating edges in a position 42*a*, so as to obtain the highest possible impedance at the resonant frequency of the patch 11*a*, doing so in the absence of the upper patch 12. To obtain a radiating element 20 with two polarizations, the patch 11*b* can comprise a set 41*b* of four demetallized slots disposed at the positions illustrated in FIG. 4*b*. The core 13 can then be centered on the axis of the patch 11*b* in a position 42*b* and the core of a second coaxial line can be centered on the other axis of the patch 11*b* in a position 43*b*. The slots allow the best possible limitation of the phase dispersion of the input impedance of the lower patch 11, thereby helping to increase the operating bandwidth of the radiating element 20.

Figure 5:
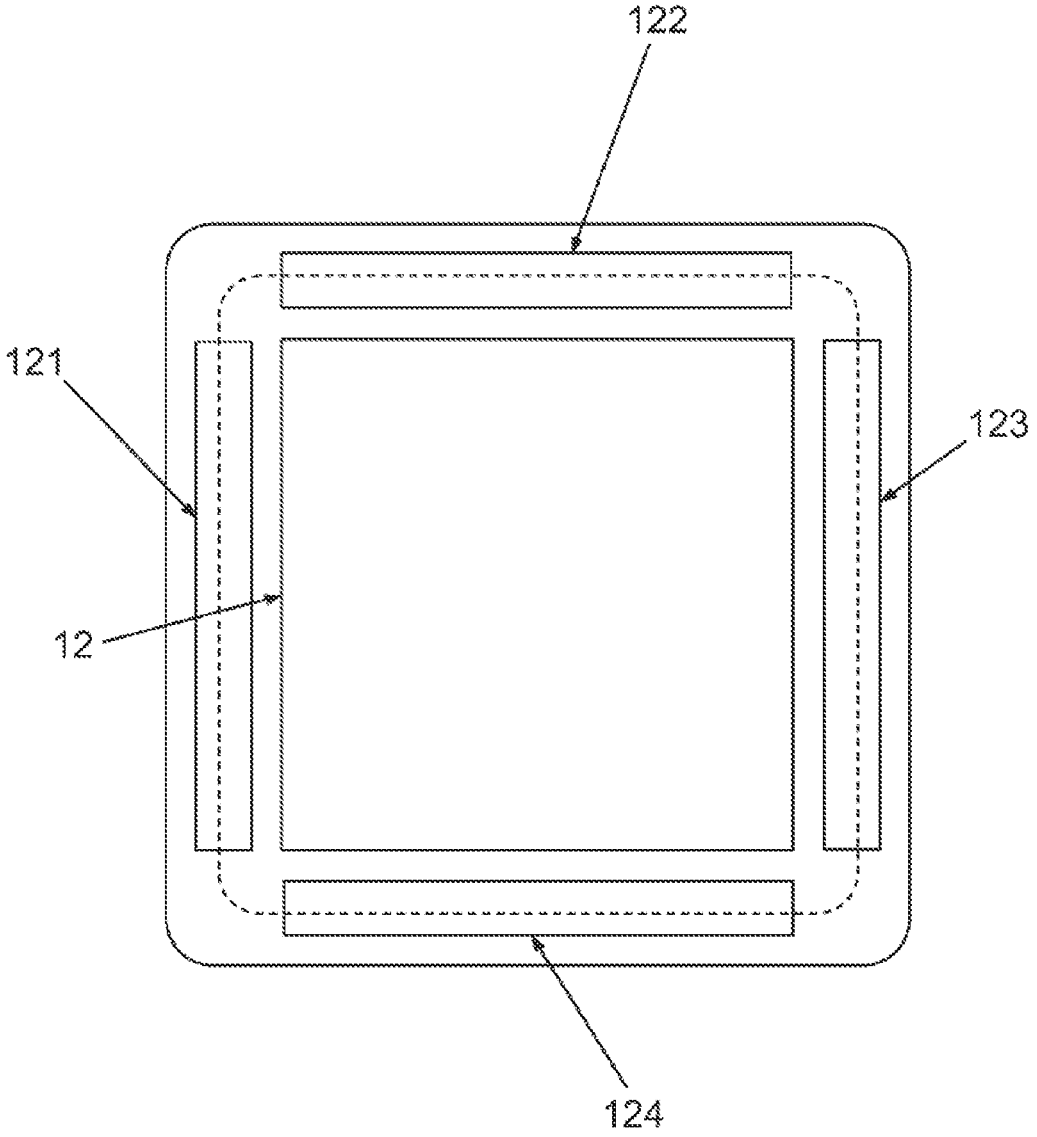
FIG. 5, an exemplary embodiment of an upper patch according to the invention.

FIG. 5 illustrates an exemplary embodiment of the upper patch 12 according to the invention. The upper patch 12 is etched on the face of the printed circuit 15 facing the lower patch 11. The patch 12 is surrounded by four parasitic elements 121, 122, 123 and 124 forming strips whose length is substantially identical to the length of the side of the patch 12. The role of the parasitic elements 121, 122, 123 and 124 is to increase the phase dispersion of the impedance referred back by the upper patch 12 onto that of the lower patch 11. They also help to increase the operating bandwidth of the radiating element 20 according to the invention.

Figure 6A:
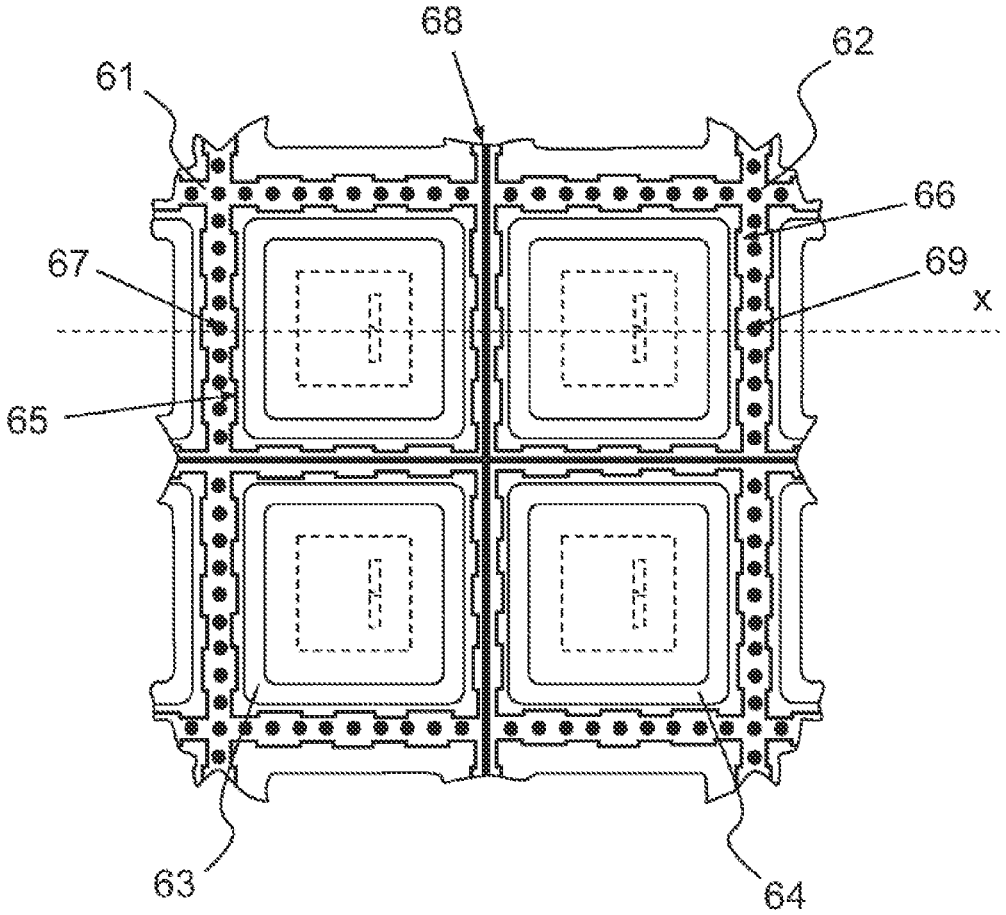
FIGS. 6*a* and 6*b*, an exemplary device according to the invention for eliminating the blind directions of an active array antenna.
Figure 6B:
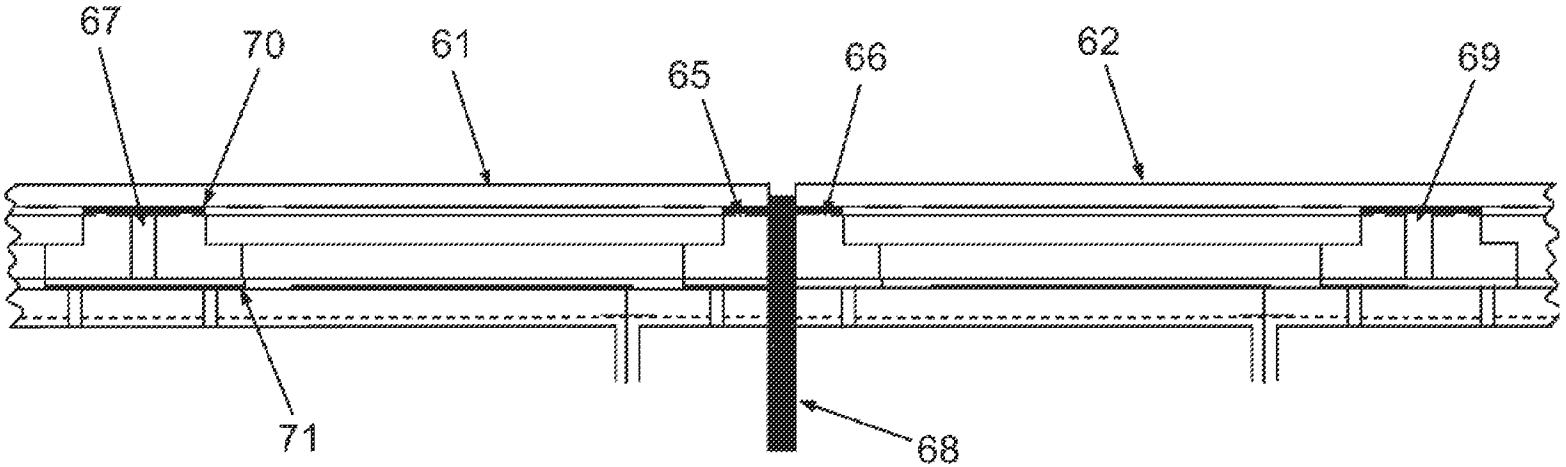

FIGS. 6*a* and 6*b* illustrate, by a top view and a sectional view in a vertical plane X respectively, an exemplary device according to the invention for eliminating the blind directions of an active array antenna. In this exemplary embodiment, four elementary tiles 61, 62, 63 and 64 are disposed in an array. The tiles of the antenna are separated from one another by a conducting seal 68 inserted between the tiles. The seal 68 can be replaced with foils. Each of these tiles is itself formed of a plurality of radiating elements disposed in an array, said radiating elements all being identical to the radiating element 20 according to the invention described above. In this exemplary embodiment, these are radiating elements with a single polarization, comprising a lower patch with two slots of the same type as the patch 11*a* illustrated by FIG. 4*a*.

In the case of an active antenna produced with the radiating elements described previously including a frame like the completely metallic frame 10 and with an array pitch allowing a pointing field of + or −45 degrees without array lobes, the pointing field in the scan plane is limited, on account of the presence of blind directions, to a maximum + or −25 degrees, more particularly in the top half of the operating band. It is possible to solve this problem by modifying the surface currents which circulate over the frame between the radiating elements. Accordingly, the frame 10 can advantageously be made of a dielectric material metallized over the whole of its external surface, with the exception of a ring-shaped slot etched or machined on the front face of the frame in the gap lying between the opening in the frame and the pitch of the array, like the slots 65 and 66. Advantageously, the dielectric constant of the material constituting the frame can be similar to those of the substrates on which the lower and upper patches are etched, such as for example the substrates of which the printed circuits 141 and 15 consist.

A layout of vias (Vertical Interconnect Access), that is to say a layout of metallized holes, can be produced along the conducting seal 68 inside the tiles, such as vias 67 and 69. Advantageously, the vias can be of a diameter equal to the thickness of the conducting seal 68. The role of these vias is to restore the periodicity of the array in the two planes at the level of the frame and although the array consists of assembled tiles.

The substrate which carries the upper patches is assembled with the frame by virtue of an insulating glue bond such as a glue bond 70 so as not to short-circuit the slots, while a conducting glue bond such as a glue bond 71 is used for the other face of the frame.

Cavities coupled to the exterior by the ring-shaped slots are thus produced around each radiating element in the volume of the frame. By optimizing their width and perimeter, it is possible to eliminate the blind directions in the E plane in a pointing field equal to + or −45 degrees in a band greater than 10%.

The invention claimed is:

1. An antenna comprising:

a plurality of tiles forming an antenna plane, each of the plurality of tiles including a plurality of radiating elements, wherein each of the plurality of radiating elements includes:

a metallic lower patch configured to receive an electric current, a metallic upper patch disposed above the metallic lower patch, a layer that separates and electrically insulates the metallic lower patch and the metallic upper patch, and a conducting frame disposed parallel to the antenna plane, the conducting frame defines an aperture and frames both the metallic lower patch and the metallic upper patch, such that both the metallic lower patch and the metallic upper patch are disposed within the aperture of the conducting frame, and such that the metallic lower patch and the metallic upper patch are coupled electromagnetically through the aperture, the conducting frame includes a body having a rear face and a front face such that:

the rear face is of a small cross section S1 disposed on the side of the metallic lower patch, and the front face is of a larger cross section S2 that is greater than the small cross section S1, the small cross section S1 is defined by a surface of a first wall extending parallel to a surface of a second wall that defines the larger cross section S2, the front face is disposed on the side of the upper patch, so as to widen an angular scan field of a beam in a plane orthogonal to the antenna plane.

2. The antenna as claimed in claim 1, wherein each of the plurality of radiating elements includes parasitic elements forming strips parallel to edges of a respective metallic upper patch.

3. The antenna as claimed in claim 1, wherein at least one metallic lower patch, is fed electric current by a core of one coaxial line having a shielding that is linked to a ground plane disposed under the at least one metallic lower patch on an opposite side to a respective metallic upper patch, the core including a capacitive disk disposed between the at least one metallic lower patch and the ground plane.

4. The antenna as claimed in claim 3, wherein the at least one lower patch includes a set of two demetallized slots, and wherein the core is connected to the at least one metallic lower patch at a position centered on an axis of symmetry of the at least one metallic lower patch and as close as possible to a radiating edge of the at least one metallic lower patch.

5. The antenna as claimed in claim 3, wherein the at least one metallic lower patch includes a set of four demetallized slots, wherein the core is connected to the at least one metallic lower patch at a position centered on a first axis of symmetry of the at least one metallic lower patch, and wherein a core of an other coaxial line is connected to the at least one metallic lower patch at a position centered on an other axis of symmetry of the at least one metallic lower patch.

6. The antenna as claimed in claim 1, wherein the plurality of tiles are separated by a conducting seal.

7. The antenna as claimed in claim 6, further comprising:

a layout of metallized holes produced inside the plurality of tiles along the conducting seal.

8. The antenna as claimed in claim 1, wherein the conducting frame is made of a dielectric material, wherein the dielectric material is metallized over a whole external surface of the body of the frame except for a slot disposed on the front face of the conducting frame.

9. The antenna as claimed in claim 8, wherein the slot on the front face of the frame is ring-shaped.

* * * * *